United States Patent [19]

Roper

[11] 4,079,974

[45] Mar. 21, 1978

[54] PROTECTIVE HASPS

[76] Inventor: Jesse G. Roper, P.O. Box 16, A-1-2, Lovelady, Tex. 75851

[21] Appl. No.: 769,815

[22] Filed: Feb. 14, 1977

[51] Int. Cl.[2] ..... E05C 19/08

[52] U.S. Cl. ..... 292/281

[58] Field of Search ..... 292/281–287, 292/346

[56] References Cited

U.S. PATENT DOCUMENTS

| | | | |
|---|---|---|---|
| 595,923 | 12/1897 | Rölker | 292/281 |
| 682,657 | 9/1901 | Wirt | 292/281 |
| 702,605 | 6/1902 | Voight | 292/281 |
| 868,540 | 10/1907 | Ferris | 292/281 |
| 1,508,384 | 9/1924 | Drake | 292/285 |
| 2,046,078 | 6/1936 | Marshall | 292/281 |
| 2,127,891 | 8/1938 | Starling | 292/346 |

*Primary Examiner*—Richard E. Moore

[57] ABSTRACT

A hasp which by its potential for bending in certain vital areas, and by its permitting an attached padlock to swivel freely, will tend to frustrate those methods usually relied upon to defeat the standard hasp-padlock protective mechanism.

1 Claim, 5 Drawing Figures

FIG. 2
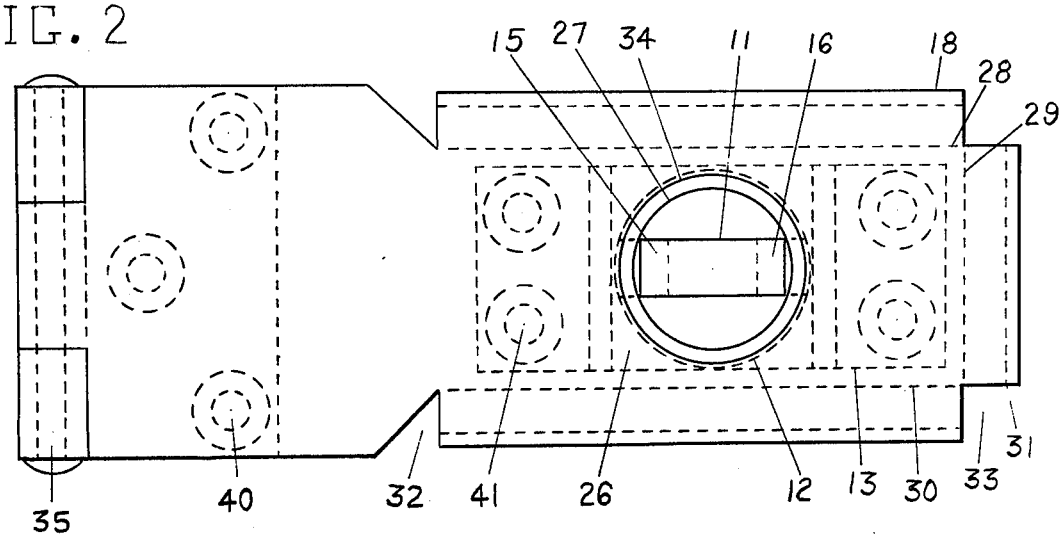
FIG. 1
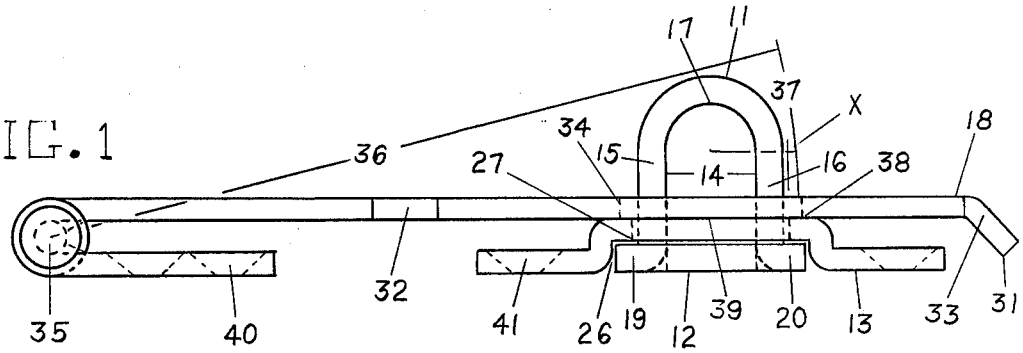
FIG. 3
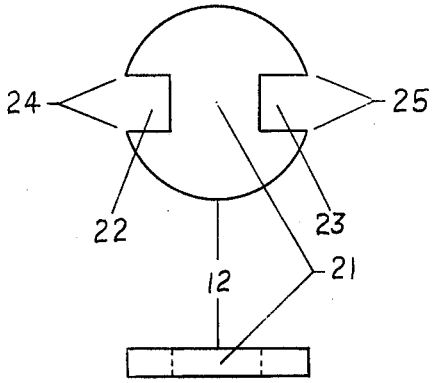
FIG. 4
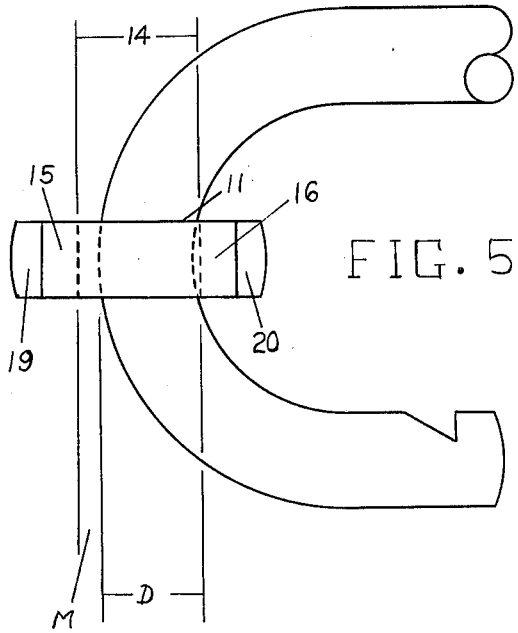
FIG. 5

PROTECTIVE HASPS

BACKGROUND OF THE INVENTION

1. Field of the invention

The present invention relates to the protective mechanism comprised of a padlock and hasp, and in particular to a hasp which protects and enhances the effectiveness of such mechanism.

2. Description of the prior art

Standard-type hasps are built around two basic sections called herein a linking section and a hinged section, and the usual mode of coupling the two sections is by means of a U-shaped metal rod, the extremities of which are rigidly connected to the linking section in such position that the curved mid-portion is extended upward and can be caused to protrude through a rectangular hole in the movable tongue of the hinged section; a padlock then being linked with the protruding curve of the rod to secure the coupling.

The above is the most familiar type of standard hasp, but there are others which differ somewhat. One such is the hasp which employs a part resembling an eye-bolt in place of the U-shaped rod mentioned above. The stem of this "eye-bolt" is connected to a swivel-base which is held by spring pressure in either of two positions 90 degrees horizontally removed from one another. In one of said positions the vertically upraised "eye" may pass freely through the hinged tongue's rectangular hole, but in its alternate position the "eye" prevents either a coupling or un-coupling of the hasp's two sections, thus enabling this type hasp to function effectively as an independent latching device.

In general, standard hasps are characterized by the fact that they, and any attached padlocks, are extremely vulnerable to a twisting and/or prying attack delivered by means of a steel bar inserted through the opening afforded by the arm of a padlock.

SUMMARY OF THE INVENTION

Like the standard hasp, this hasp has a linking section and a hinged section; however, the means of coupling the sections of this hasp is unique: coupling is effected by the protrusion of a swivel-mounted "stud" of the linking section through a circular hole in the hinged section's tongue. The stud is formed from a rectangular strip of tough, malleable metal (mild steel, etc.), and this strip is particularly dimensioned so as to possess desired bending potential. An open channel through the stud's center is dimensioned to afford only that space considered necessary for maneuvering the arm of a padlock therein. The swivel-action of the stud protects the hasp-padlock against a twisting, shearing attack with a steel bar, etc., but equally advantageous is the fact that in the case of a prying, pulling attack upon the padlock, the swivel allows the stud to allign itself in such direction that the stud's rectangularly cross-sectioned material may most readily bend and thereby relieve tension which would otherwise be concentrated largely within the lock's mechanism. Similarly, the hinged tongue is provided with forty-five-degree down-turned bends across its outer end and along portions of each side which cause these areas to offer precarious footing and weak support for a prying implement.

Various construction details facilitate and protect the bending and swiveling qualities mentioned above, and the net result is a hasp which has a calculated tendency to yield to, rather than resist, the prying-twisting assaults commonly used to defeat the standard hasp-padlock mechanism.

Accordingly, a primary objective of the invention is to provide a hasp which is much less vulnerable to an attack by the usual methods, and which will compell a potential burglar or thief either to consume more time and energy in overcoming the hasp-padlock mechanism in the usual manner, or to adopt and familiarize himself with different tools and techniques; either alternative resulting in his exposing himself to increased risk of discovery or detection.

A further object of the invention is to provide a hasp which, while affording unique protection to an attached padlock, retains sufficient resemblance to standard hasps as to permit its being manufactured with no great departure from established production and assembly procedures.

BRIEF DESCRIPTION OF THE DRAWINGS

In the drawings, which demonstrate the working principles of the hasp but which must be appropriately scaled to accomodate padlocks having various arm-diameters:

FIG. 1 is a side elevational view of the hasp's two sections less mounting screws; however, in order to represent details of the Linking Section more clearly, this drawing shows the Tongue 18 as it would appear before 45-degree bends are made along portions of each side thereof; also, the Disc 12 is shown as being somewhat smaller than it would actually be, FIG. 2 is a diagramatic plan view of the hasp's two sections less mounting screws, and this view, in conjunction with the view in FIG. 1, shows the correct relative positions of the two sections;

FIG . 3 is a plan view of the Disc 12;

FIG. 4 is a side elevational view of the Disc 12;

FIG. 5 is an enlarged plan view of the Stud 11, with the arm of a padlock linked thereto; this view shows factors influencing the dimensions of the Stud's Channel 14.

DESCRIPTION OF PREFERRED EMBODIMENTS

All critical dimensions of the presently invented portion of this hasp are derived either directly or indirectly from the diameter of the padlock-arm a particular construction of the hasp must accomodate.

The Linking Section is comprised of the Stud 11, the Disc 12, and the Foundation Plate 13.

The Stud 11, FIGS. 1, 2 and 5, is constructed, preferably, from a rectangular strip of tough, malleable metal such as mild steel, etc., the width of which strip is equal to the diameter of the padlock-arm to be accomodated plus or minus a maximum of twenty-five percent, and the thickness of which is not less than one-third nor more than two-thirds the width thereof. The width of the Channel 14, or the horizontal distance between the Legs 15 and 16, FIGS. 1 and 5, and, hence, the radius of the curved, upper portion of the Stud 11, are determined as indicated in FIG. 5 where the value of D is self-explanatory, but where M is maneuvering space allowed for the lock-arm, and is not less than 1/32 inch nor more than 3/32 inch. Using the width and radius thus determined, the Stud's strip is bent to the shape indicated in FIG. 1, and allowance must be made to insure that, with the two sections coupled as in FIG. 1, the vertical measurement between point 17 (the interior peak of the curve) and the upper surface-level of the Tongue 18 is equal to the above described width of the Channel 14. Feet 19 and 20, FIGS. 1 and 5, project at right angles to, and for equal-minimum distances of 1/16 inch from their respective Legs, and the horizontal distance between the outer, center extremities of said feet is the Span of the Stud 11.

The Disc 12, FIGS. 3 and 4, is built of metal similar in nature and equal in thickness to that used for the Stud 11, and the Disc's diameter is equal to the above described Span of the Stud 11. The Bridge 21, FIG. 3, bisects the Disc, and separates the Slots 22 and 23 by a distance equal to the previously described width of the Channel 14, FIGS. 1 and 5. The Slots 22 and 23 are dimensioned to receive the Feet 19 and 20 of the Stud 11, as indicated in FIGS. 1 and 2, and the Stud and Disc are permanently joined by welds at 24 and 25, FIG. 3.

The Foundation Plate 13, FIGS. 1 and 2, is built, preferably, from a harder, less malleable metal than that used for the Stud 11. It is formed as indicated to provide the Housing 26 which is dimensioned in depth and width to contain the Disc 12. Immediately above and concentric with the Housing 26 is the circular Stud Hole 27, the diameter of which is equal to the horizontal, diagonal distance between outer and opposite edges of the Legs 15 and 16, FIGS. 2 and 5.

The Tongue 18, FIGS. 1 and 2, is a part of the Hinged Section, and is constructed, preferably, from metal identical in both type and thickness to that used for the above mentioned Foundation Plate 13. Forty-five-degree down-turned bends along the dashed lines 28, 29 and 30, FIG. 2, cause the lower edges of these bent sections to lie in a plane approximately 1/16 inch above the lower surface of the Foundation Plate 13, as is indicated at 31, FIG. 1. The Triangular Notches 32, and Plugged Corners 33, FIG. 2, permit said bends to be made. The Tongue 18 must be of sufficient width that after the side bends 28 and 30 are made, adequate space remains between said bends to accomodate the circular Coupling Hole 34. The radius of this Coupling Hole is determined as follows: intersects with a vertical projection from that point on the circumference of the Stud Hole 27 most distant from the Hinge 35, and, therefore, Point X is the most extreme point which the Stud 11 will reach when revolved horizontally; the Radius 36 is adjusted so that the Arc 37 clears Point X by approximately 1/16 inch and Point 38 is where a projection of the Arc 37 would intersect with the lower surface of the Tongue 18; Point 39 is where the vertical axis of the Stud intersects with that same lower surface; by using the horizontal distance between Points 38 and 39 as a radius for the Coupling Hole 34, and using the vertical axis of the Stud 11 as the pivotal point therefor, the Coupling Hole thus obtained will permit a coupling or un-coupling of the hasp's two sections, regardless of what position the Stud might be turned to.

The sections of this hasp are mounted to a structure exactly as those of a standard hasp would be, and for this purpose countersunk holes dimensioned to accomodate 5/32 inch flathead screws are shown at 40 and 41, FIGS. 1 and 2.

While this hasp's swivel remains functionable, the hasp-padlock mechanism is invulnerable to the type of twisting, shearing attack commonly used to defeat the standard hasp and its padlock, and for protection of this swiveling capacity the dimensions of the Channel 14, FIGS. 1 and 5, are kept to a practical minimum so that after the lock-arm is inserted, very little space remains for an object which might otherwise be intruded and used to prevent rotation of the Stud 11. Similarly, the down-turned sides and end of the Tongue 18, FIGS. 1 and 2, act as shields for the hasp's swivel; however, the primary function of these bent sections is to prevent the hasp itself being used as an effective base for a prying implement: the 45-degree slopes of these down-turned sections offer a precarious footing for a steel bar, etc., and should such a footing nevertheless be used, these bent and thereby weakened edges, when pried against, will tend to yield, or bend further, as pressure is applied.

In furtherance of the above mentioned yielding characteristic of the hasp, the swivel-mounting of the Stud 11 performs a second vital function: the swivel assures that when an attached padlock is pried against in the usual manner, the pull upon the lock will cause the Stud 11 to allign itself in a direction such that the width/-thickness ratio of the Stud's material will offer the least relative resistance to bending, and the malleable quality of the material will enable the Stud to withstand a considerable amount of such bending, or yielding, without fracturing.

Another advantage of this hasp's construction is that the material of the Stud 11 lays relatively close against the arm of an attached padlock and is less exposed and accessible than is the U-shaped rod used by most standard hasps.

Wherefore I claim:

1. A stud and disc for use in the linking section of a Protective Hasp; said stud being formed from a rectangular strip of malleable metal which strip has a thickness equal to not less than one-third nor more than two-thirds the width thereof, and said width being equal to the diameter of the lock-arm to be accomodated plus or minus a maximum of twenty-five percent; said disc being constructed of metal similar to, and having the same thickness as, that used to construct said stud; said stud being connected to said disc by means of horizontally projecting feet on said stud which feet fit within rectangular and diametrically opposed slots of said disc and are fastened therein by welding.

* * * * *